United States Patent [19]

Mueller et al.

[11] 4,278,383

[45] Jul. 14, 1981

[54] BAG OPENING AND EMPTYING APPARATUS

[75] Inventors: Edward E. Mueller, Tonka Bay; Michael K. Harrod, Prior Lake; Frederick C. Hagemeister, Isanti, all of Minn.

[73] Assignee: Whirl-Air-Flow Corporation, Minneapolis, Minn.

[21] Appl. No.: 952,316

[22] Filed: Oct. 18, 1978

[51] Int. Cl.[3] ..... B65G 65/34

[52] U.S. Cl. ..... 414/412; 198/692; 414/418

[58] Field of Search ..... 414/412, 418; 198/692, 198/693

[56] References Cited

U.S. PATENT DOCUMENTS

| | | | |
|---|---|---|---|
| 3,664,530 | 5/1972 | Takiguchi | 414/412 |
| 4,119,227 | 10/1978 | Hafner et al. | 414/412 |

FOREIGN PATENT DOCUMENTS

| | | | |
|---|---|---|---|
| 2012814 | 9/1971 | Fed. Rep. of Germany | 414/412 |

*Primary Examiner*—Robert G. Sheridan

*Attorney, Agent, or Firm*—Merchant, Gould, Smith, Edell, Welter & Schmidt

[57] ABSTRACT

Apparatus and method of automatically opening and emptying bags. The apparatus includes a bag outlet, a bag inlet, and a bag contents collection hopper. The housing has a cutting zone, a bag emptying zone, and a bag ejection zone to cut through opposite sides of the bags as the bags are transported lying generally horizontally. A conveyor is disposed within the housing for transporting the bags between the inlet and outlet. The conveyor includes a track member and a carrier member. Elongated piercing members are mounted on the carrier member to positively engage the bags along opposite lateral edges thereof. A ramp member is provided on the track member to tilt the opposite lateral edges of the bag upward and toward each other as the carrier member rides thereon.

6 Claims, 9 Drawing Figures

BAG OPENING AND EMPTYING APPARATUS

BACKGROUND OF THE INVENTION

The present invention relates broadly to an apparatus for automatically cutting and emptying the contents of a bag and in particular to an industrial bag breaking and emptying apparatus wherein bags containing granular or powdered type products are opened and emptied within a contained environment.

Granular or powdered type products which are packaged in plastic or paper bags are utilized in many industrial applications. Significant quantities of such products may be utilized on a daily and hourly basis. It may therefore be necessary to open many such bags during the industrial work day. In some applications, the contents of the bags may have a detrimental effect on individuals exposed thereto.

It is desirable, therefore, to have an apparatus which will automatically open and empty such a bag and maintain an environment substantially free of dust or other potential harmful contents of the bag. Prior apparatus has been developed to meet these general requirements. These prior apparatus generally include an enclosed housing in which the bags are cut and the product therein emptied. Some means is typically provided for conveying the bag through the housing and ejecting the cut bag from the housing. The bagged material is collected within the housing and disposed of by convenient means. The apparatus may be provided with a filter to collect the dust generated by the cutting and emptying operating.

The present invention is an improved bag opening and emptying apparatus that postively engages the bags along opposite lateral edges of the bags throughout the entire cutting and emptying operation while the bags are conveyed through the apparatus lying generally horizontally. The positive engagement mechanism can be adjusted such that the bag is engaged as close as possible to the lateral edges to ensure a more complete emptying of the bag contents. In the apparatus of the present invention material waste is substantially eliminated and the possibility of bag contents becoming collected on the conveyor is significantly reduced. The bags are, as previously mentioned, positively engaged by the conveyor mechanism throughout the cutting and emptying steps and then positively engaged to eject the bags from the apparatus. The present invention thereby maximizes the material usage by substantially eliminating loss through more efficient dumping of bag contents and minimizing operator maintenance and machine downtime by eliminating problems of jamming due to bag contents becoming lodged within the conveyor mechanism. Additionally, in the present invention the adjustable positive engagement means facilitates use of the apparatus with various size bags.

SUMMARY OF INVENTION

The present invention is a bag opening and emptying apparatus that includes a substantially enclosed housing with a bag inlet, and a bag outlet, and means for collecting the bag contents. The apparatus further includes conveyor means for transporting the bags between the bag inlet and the bag outlet. The housing has a cutting zone proximatey the inlet end, a bag ejection zone at its outlet end, and bag emptying zone generally between the cutting and ejection zones. Means is disposed within the cutting zone for cutting through opposite sides of the bags as the bags are transported lying generally horizontally. The conveyor means includes a carrier member and a conveyor track on which the carrier member is mounted. The conveyor means further includes means on the carrier member for positively engaging the bags along opposite lateral edges thereof. Means is provided on the track for tilting the lateral edges of the bag generally upward and inward in the bag emptying zone to ensure more complete dumping of the bag contents.

In the preferred embodiment, the conveyor means includes first and second conveyor carriages which are spaced horizontally within the housing and extend generally between the inlet and outlet ends of the housing. The first and second carriages have substantially planar top surfaces and first and second endless conveyor members are disposed on the conveyor carriages for travel on the planar top surfaces in a generally horizontal plane. On each conveyor member a plurality of elongated piercing members are spaced apart for positively engaging the opposite lateral edges of a bag by puncturing the bag along the bag edges. The tilting means includes ramps mounted on the planar top surfaces of the first and second conveyor carriages in the bag emptying zone. Each ramp has a surface sloping inward toward what can be defined a central elongation axis of the housing and downwardly. As the conveyor members ride on the sloping surface of the ramp the elongated piercing members are tilted inward toward the elongation axis of the housing at an angle with respect to the vertical. In the bag emptying zone, a beater member may be provided to strike the cut bag to ensure more complete dumping of the contents thereof. Hold down rods are mounted within the housing in the bag emptying zone to hold the bag on the elongated piercing member while the bag beater is striking the bag.

The present invention also includes a method for automatically opening and emptying bags that includes the step of introducing the bag into a substantially enclosed housing. The bags are positively engaged along the lateral edges thereof and conveyed in a substantially horizontal plane between the inlet and the outlet of the housing. The bags are cut through opposite sides thereof between the bag lateral edges and the lateral edges of the bag are then tilted upwardly from the horizontal to dump the bag contents therefrom. The bags are then removed from the housing. In the preferred method, a step of beating the bags is included while the lateral edges of the bags are tilted.

The present invention is therefore a method and apparatus for automatically opening and emptying bags that maximizes dumping of the bag contents. The bags are being conveyed generally lying horizontally and opposite sides of the bags are cut through between opposite lateral edges thereof. The lateral edges are tilted to dump contents from the severed portions of the bag while the severed portions are beaten. The present invention achieves a minimum of loss of bag contents and substantially eliminates the problems of bag contents becoming lodged in conveyor mechanisms resulting in jamming of the bag emptying apparatus. The present invention has application in many industrial environments where granular and powdered-like material are packaged in bags that must be opened while maintaining a substantially pollution free safe work environment. These and other advantages of the present invention will become apparent with reference to the accompanied drawings, detailed description of the preferred embodiment and claims.

DETAILED DESCRIPTION OF THE PREFERRED EMBODIMENTS

Figure 1:
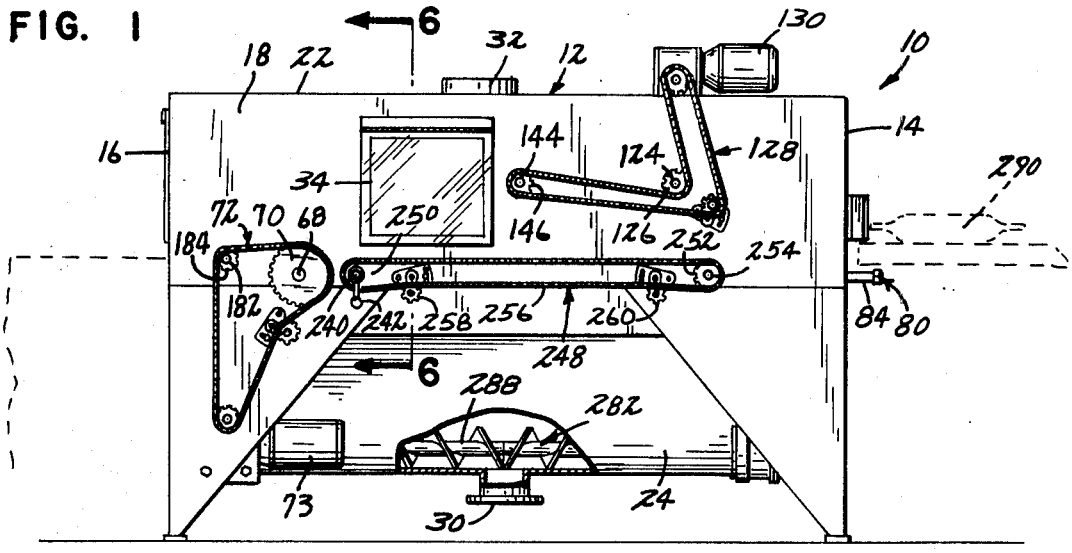
FIG. 1 is a side elevational view of one side of the apparatus of the present invention.
Figure 2:
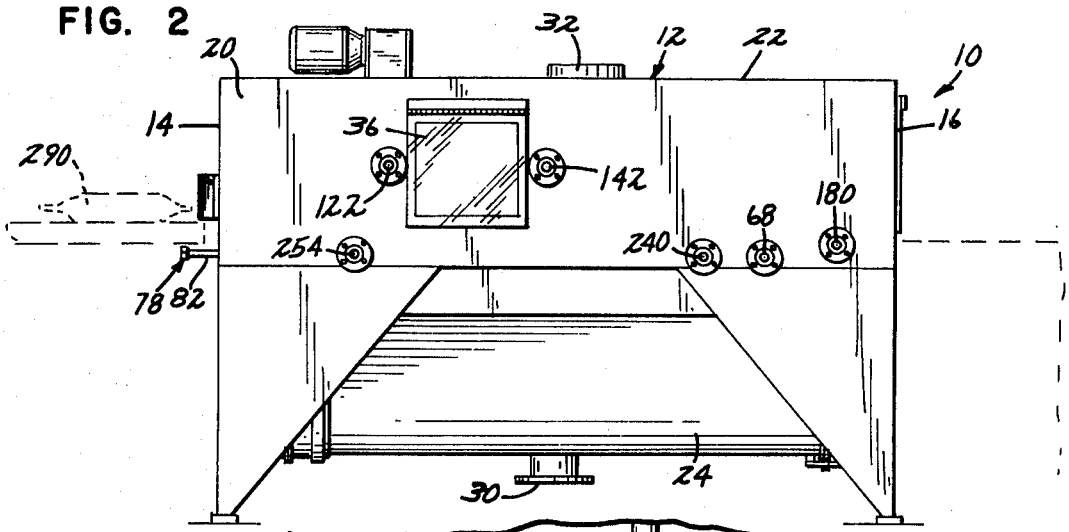
FIG. 2 is a side elevational view of the opposite side of the apparatus of the present invention.
Figure 3:
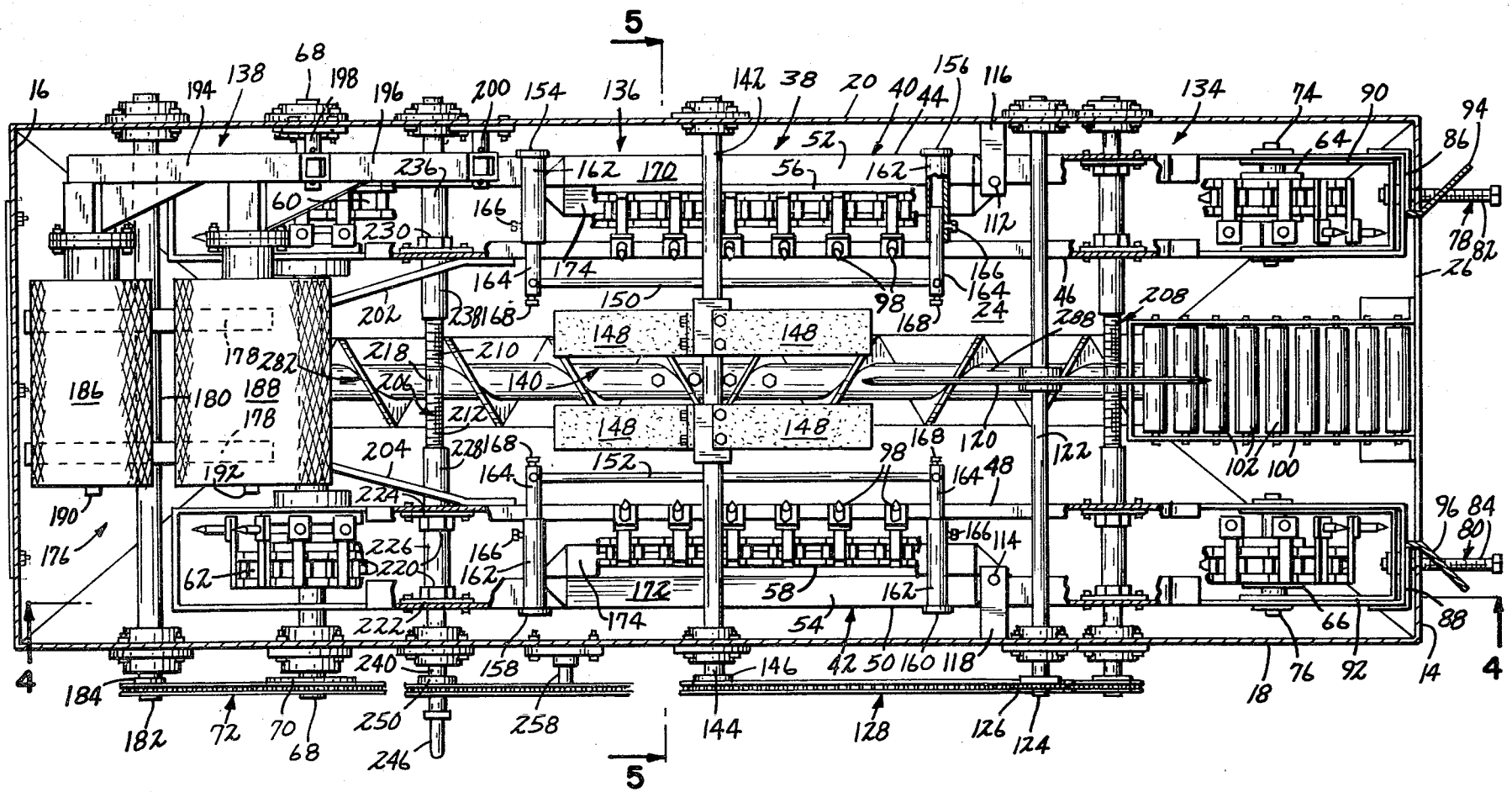
FIG. 3 is a top plan view of the apparatus of the present invention with the top wall removed and parts omitted for clarity of illustration.
Figures 4, 5, 9:
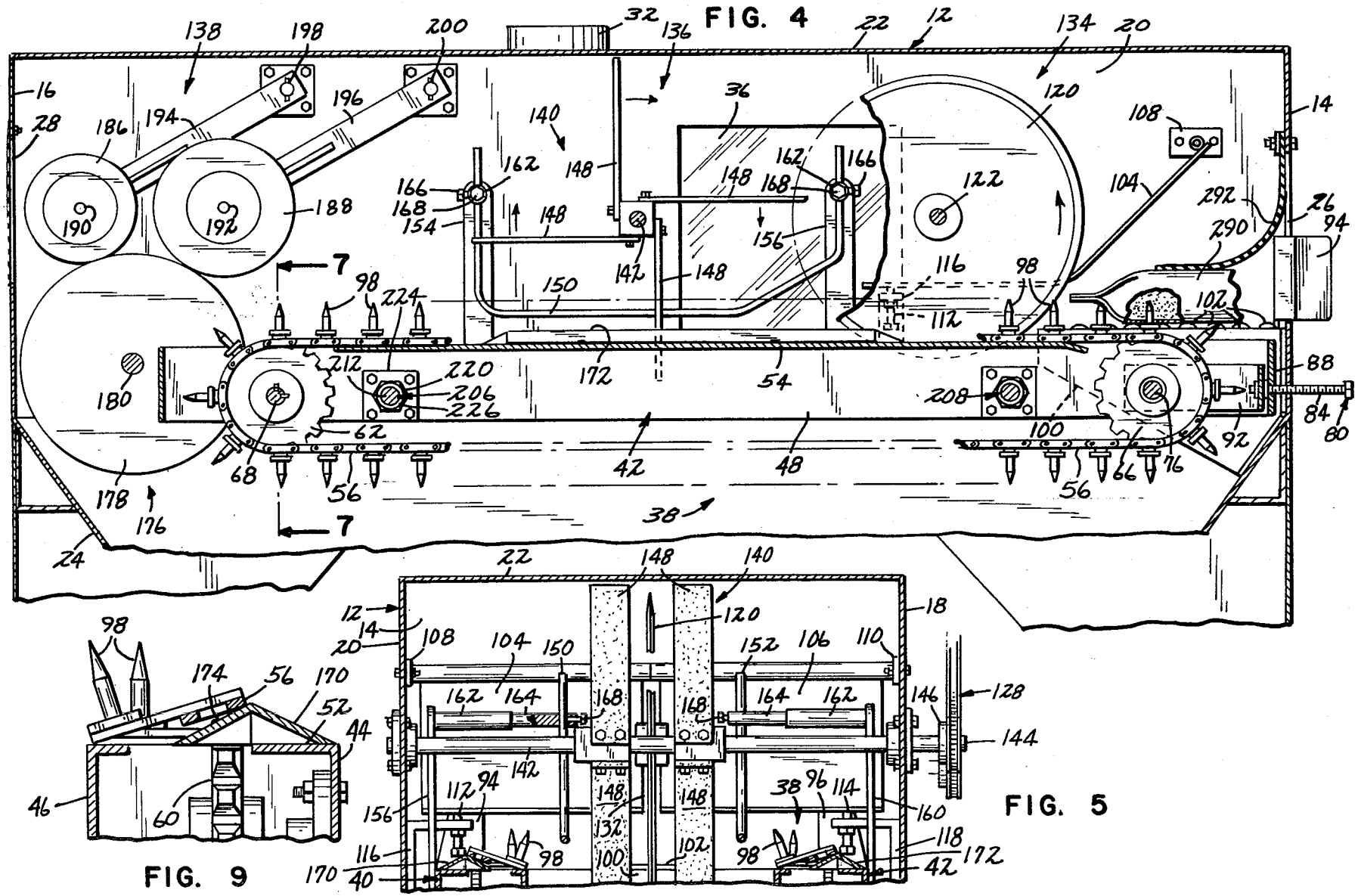
FIG. 4 is a sectional view in elevation taken generally along the line 4—4 of FIG. 3.
FIG. 5 is a partial view in section taken generally along the line 5—5 of FIG. 3.
FIG. 9 is an enlarged fragmentary view in section illustrating the conveyor track in the bag emptying zone.

Referring to the drawings, wherein like numerals represent like parts throughout the several views, the bag opening and emptying apparatus of the present invention is designated generally as 10. Apparatus 10 includes a housing 12 with end walls 14 and 16, sidewalls 18 and 20, a top wall 22, and a bottom wall 24. Housing 12 is generally horizontally elongated between end walls 14 and 16 having a horizontally disposed elongation axis. End wall 14 has a bag inlet opening at 26 and end wall 16 has a bag outlet opening at 28. With particular reference to FIGS. 1, 3, and 4, bags are transported generally from right to left from bag inlet opening 26 to bag outlet opening 28. As will be described in more detail hereafter, the filled bags are cut and the contents emptied within housing 12 and the bag ejected through outlet opening 28. Bottom wall 24 defines a collection hopper which receives the contents of the bags. The collected contents are discharged from housing 12 through an outlet 30. Particulate dust generated in opening and emptying bags within housing 12 may be removed through an outlet 32 which preferably is connected to a conventional dust filter (not shown) so that the dust will not be dispersed into the work area surrounding apparatus 10. As shown in FIGS. 1 and 2, sidewalls 18 and 20 may be provided with observation windows 34 and 36 whereby the interior of housing 12 can be observed during operation of apparatus 10.

The interior of housing 12 is shown in more detail particularly in FIGS. 3–5. A conveyor means or mechanism designated generally as 38 is mounted within housing 12 for carrying the bags between inlet opening 26 and outlet opening 28. Conveyor mechanism 38 includes a pair of conveyor carriages or conveyor tracks 40 and 42 each having axis elongated generally in the direction between inlet and outlet openings 26 and 28 and which are parallel to each other and lie generally in a common horizontal plane. Carriages 40 and 42 are mounted for transverse reciprocation to and away from each other in a direction generally normal to the elongation axis and to the direction of travel of the bag between inlet opening 26 and outlet opening 28. The transverse reciprocating mounting of carriages 40 and 42 will be described in more detail hereafter.

Carriages 40 and 42 include sidewalls 44 and 46 and 48 and 50, respectively. As shown in more detail in FIG. 6 carriages 40 and 42 also have topwalls 52 and 54, respectively. Mounted to carriages 40 and 42 are endless belt means or carrier members which, in a preferred embodiment, comprises endless chains 56 and 58 which are mounted about drive sprockets 60 and 62 and driven sprockets 64 and 66, respectively. Referring to FIG. 3, sprocket 60 is driven in a counterclockwise direction causing the top portion of chain 56 to travel from right to left while the bottom portion of chain 56 travels from left to right. Drive sprockets 60 and 62 are mounted on a drive shaft 68 as will be described in more detail hereafter. Shaft 68 is rotatably journalled to sidewalls 18 and 20. Drive shaft 68 extends through sidewall 18 and an extension thereof has a drive wheel or sprocket 70 mounted thereon. Sprocket 70 is rotatably driven by a chain-type drive designated generally as 72 which is connected to a drive motor 73. Driven sprockets 64 and 66 are mounted on shafts 74 and 76, respectively, which are rotatably mounted to the sidewalls of carriages 40 and 42. The tension on chains 56 and 58 may be adjusted by tensioning mechanisms 78 and 80. In a preferred embodiment, tensioning mechanisms 78 and 80 may included threaded bolts 82 and 84 received within threaded apertures in end walls 86 and 88 of carriages 40 and 42. Bolts 82 and 84 also rotatably received in apertures in tensioning frame members 90 and 92 in which shafts 74 and 76 are rotatably mounted. By thus rotating bolts 82 and 84, frame members 90 and 92 can be drawn toward end walls 86 and 88 thereby increasing the tension on the chain wrapped about the sprockets 60 and 64 and sprockets 62 and 66. It will be understood that other convenient tensioning mechanisms that are the equivalent of the ones specifically disclosed herein are contemplated within the spirit and scope of the present invention.

Attached to conveyor carriages 40 and 42 and extending outwardly through inlet opening 26 are bag guide plates 94 and 96, respectively. Guide plates 94 and 96 are planar members which function to guide the incoming filled bags into proper position on conveyor mechanism 38. Plates 94 and 96 may be affixed to conveyor carriages 40 and 42 by any convenient means, such as welding.

Affixed to endless conveyor chains 56 and 58 and spaced apart thereon are elongated piercing members or pins 98 having a sharpened pointed end whereby pins 98 puncture the bag to positively engage and carrying the bag from inlet 26 to outlet end 28. As will be described in more detail hereafter, carriages 40 and 42 may be adjusted so that pins 98 puncture and engage the bag along its lateral edges according to the size of the bag. The bag will be firmly on the conveyor by a purality of such pins which will grip and puncture the bag at spaced intervals along the opposite lateral edges thereof. The pins 98 may be fixed to chains 56 and 58 by any convenient means known in the prior art. As shown more particulary in FIG. 3, chains 56 and 58 during a substantial portion of travel from inlet opening 26 toward outlet opening 28 ride on the topwalls 52 and 54 of conveyor carriages 40 and 42. In the preferred embodiment, a layer of material with a low co-efficient of friction maybe adhered or affixed to top walls 52 and 54. A layer of Teflon, for example, provides a suitable sliding surface for chains 56 and 58. It should also be understood that chains 56 and 58 are representative of a number of equivalent conveyor structures that are contemplated within the spirit and scope of the present invention. As an alternative to chains 56 and 58, for example, an endless belt may also be utilized and have elongated pins 98 mounted therein.

Disposed proximate inlet opeing 26 and mounted to housing 12 is a generally horizontally oriented frame 100 in which is rotatably mounted a purality of cylindrical rollers 102. Rollers 102 provide support for filled bags as they are introduced into inlet opening 26 before the bags are completely supported by the engagement of the bags with pins 98. Also disposed proximate inlet opening 26 is a pair of plates 104 and 106. One end of plates 104 and 106 are pivotably mounted by convenient means to sidewalls 18 and 20 at 108 and 110 respectively. Plates 104 and 106 extend downward from their pivotal mountes 108 and 110 to a point about pins 98 and then extend generally horizontally. The ends of plates 104 and 106 opposite pivotal mounts 108 and 110 may be adjusted vertically by means of bolts 112 and 114 threadedly received within supports 116 and 118 and mounted on side walls 18 and 20. Bolts 112 and 114 are in contact with plates 104 and 106. Adjustment of bolts 112 and 114 will raise and lower the end of plates 104 and 106 opposite pivotal mounts 108 and 110, respectively. Plates 104 and 106 are typically positioned so that they will engage bags as they are entering through opening 26 to urge the bags downward to ensure that bags are properly punctured and engaged by pins 98. The downward force of plates 104 and 106 may be provided by the weight thereof and/or plates 104 and 106 may be spring biased downward at pivotal mounts 108 and 110.

Mounted within housing 12 for rotation in a substantially vertical plane is a cutting disc 120. Disc 120 is mounted on a shaft 122 having a horizontal rotational axis and which is rotatably journaled to sidewalls 18 and 20 of housing 12. Shaft 122 has an extension 124 which projects exteriorly of sidewall 18. A drive wheel, sprocket or pulley 126 is secured to extension 124. Drive wheel 126 is driven by a chain drive arrangement 128 that includes a motor 130. In a preferred embodiment, the rotation of shaft 122 is such that there is an upward cutting action of disc 120. As shown in FIG. 4, the rotational direction can be defined as counterclockwise. Plates 104 and 106 aid in maintaining the bag firmly in place on pins 98 as the bags are cut with this generally upward cutting rotation of disc 120. Plates 104 and 106 and spaced apart to provide an opening 132 in which disc 120 rotates without interference from plates 104 and 106.

The interior of housing 12 can generally be divided into a cutting zone 134, a beating zone 136 and an ejection zone 138 in that order from inlet end 26 to outlet end 28. Disc 120 is disposed in cutting zone 134 of apparatus 10. Disposed within beating zone 136 is a beater apparatus 140. Beater apparatus 140 includes a shaft 142 having a substantially horizontally disposed rotational axis which is rotatably journalled to sidewalls 20 and 18. Shaft 142 has an extension 144 exterior of sidewall 18. Affixed to extension 144 is a drive wheel, spocket, or pulley 146. Drive wheel 146 is associated with chain drive arrangement 128 and driven by motor 130. Chain drive arrangement 128 is designed so that shaft 142 will rotate in a direction opposite to that of shaft 122. Defined with respect to FIG. 4, the rotation of shaft 142 is in a clockwise direction. Mounted to shaft 142 are beater members 148. In the preferred embodiment the beater members 148 may be strips of rubber or other suitable material that extend generally radially outward from the rotational axis of shaft 142. Beater members 148 are disposed so that upon rotation of shaft 142 beater members 148 will continually strike bags that have been cut by disc 120. Also positioned within beating zone 136 is a pair of bag hold down bars 150 and 152. Bars 150 and 152 are mounted to carriages 40 and 42 by pairs of vertical support arm 154 and 156 and 158 and 160, respectively. Support arms 154–160 are attached to carriers 40 and 42 by any convenient means, and typically may be welded thereto. As shown in FIG. 5, a tubular member 162 is affixed to vertical support 156 and extends horizontally inward with respect to the central elongation axis of apparatus 10. Cylindrical member 164 is received within tubular member 162 and slides therein. Rod 150 is received within a cylindrical passageway in member 164. Bolts 166 and 168 are provided to secure tubular member 162 and rod 150, respectively. Each vertical support arm 154–160 has an identical structure described with respect to support arm 156. It can be seen that the positioning of rods 150 and 152 can thereby be adjusted both vertically and horizontally. Rods 150 and 152 are typically disposed proximately the edges of bags being conveyed through apparatus 10 and in position to hold the bags down while the bags are being struck by better member 148. Within beating zone 136 elongated ramps or wedge members 170 and 172 are affixed to topwall 52 and 54 of carriages 40 and 42, respectively. As shown more specifically in FIG. 3 ramps 170 and 172 typically extend from cutting disc 120 to vertical support members 154 and 158. As shown in the enlargement view of FIG. 9, ramp member 170, in the preferred embodiment, is simply an angle iron welded or affixed by other convenient means to top wall 52 of carriage 44. Ramp member 170 provides a surface 174 which slopes inwardly toward the central elongation axis of apparatus 10. While top wall 52 lies in a substantially horizontal plane, surface 174 can be described by lying in a plane disposed inward at an angle with respect to the horizontal. As chain 56 rides over ramp member 170, ramp surface 174 raises and tilts chain 56 directing pin 98 generally inward. The pins 98 are also disposed slightly nearer sidewall 46 of carrier 44. As chain 56 rides over ramp 170 it can be seen that pins 98 are disposed inward at an angle with respect to the vertical. As will be described in more detail hereinafter ramp 170 thereby facilitates more complete emptying and discharging of the content of the bags.

Positioned within ejection zone 138 is a bag ejection apparatus 176. Ejection apparatus 176 includes rollers 178 disposed proximate outlet end 28 and mounted to a shaft 180. Shaft 180 has a substantially horizontally disposed rotational axis and is rotatably journalled in sidewalls 18 and 20. Shaft 180 has an extension 182 which projects outward from sidewall 18 and to which is mounted a pulley, wheel, or sprocket 184. Wheel 184 is driven by chain drive apparatus 72. In the preferred embodiment, rollers 178 if viewed with respect to FIG. 4 are driven rotationally in the counterclockwise direction. Rollers 178 are in the preferred embodiment disc like cylindrical members and cooperate with a pair of rollers 186 and 188 to lift the bag from pins 98 and eject the bag through opening 28. Rollers 186 and 188 are also cylindrical members which are mounted for rotation about horizontally disposed shafts 190 and 192. Shafts 190 and 192 are rotatably journalled in support arms 194 and 196 which are pivotally mounted to sidewall 20 at 198 and 200. The weight of rollers 186 and 188 maintains the rollers in contact with the surface of rollers 178. Affixed to inner sidewalls 46 and 48 of carriages 44 and 42 are guide rods 202 and 204. Guide rods 202 and 204 may be welded to sidewalls 46 and 48 and extend inward therefrom and upward at an angle with respect to the horizontal. Rods 202 and 204 form a gradually upward directed ramp which functions to lift the empty bags from the engagement with pins 98 and direct the bags into contact with cooperating rollers 178 and 188.

Figure 6:
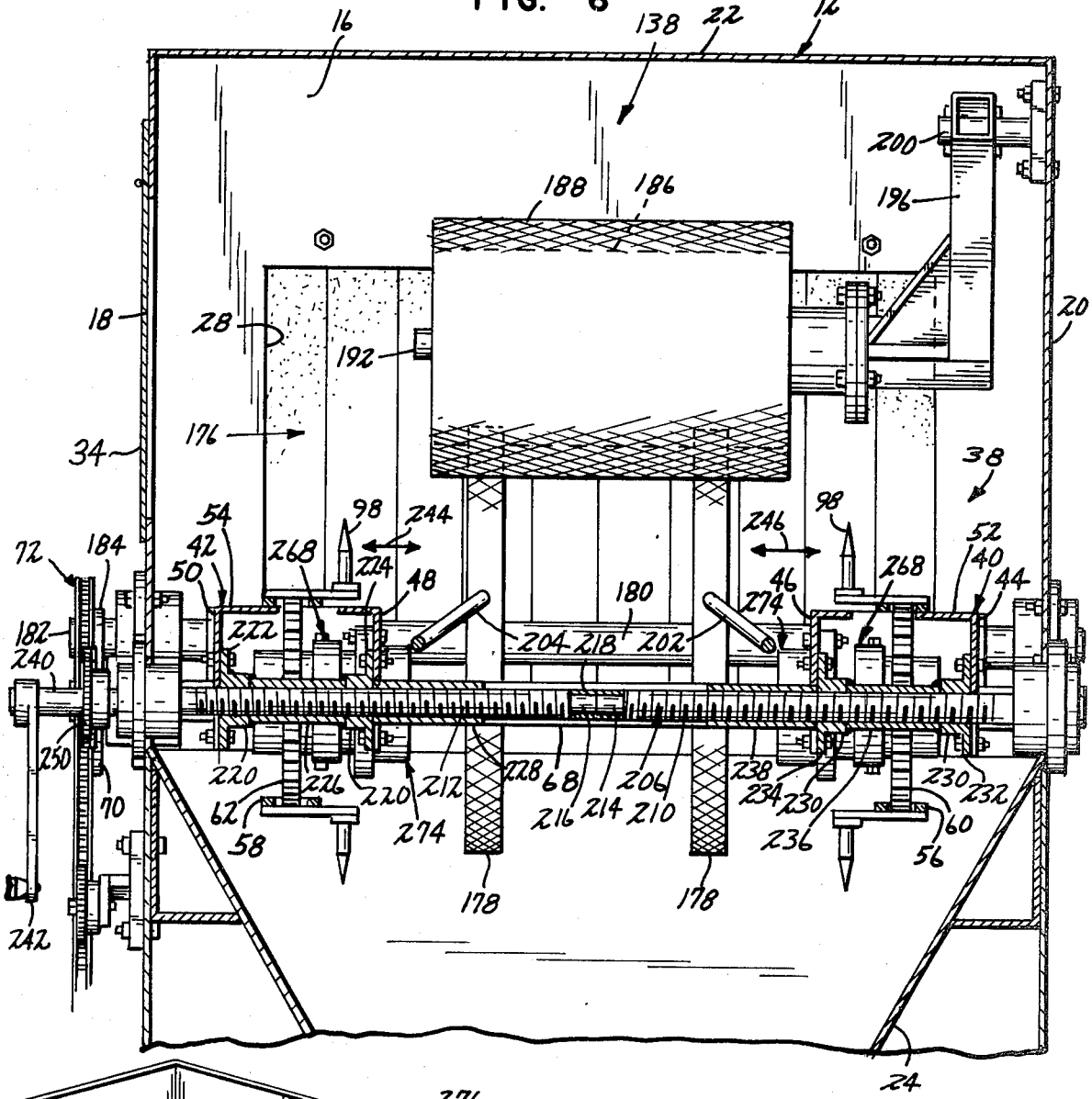
FIG. 6 is an enlarged view in section taken generally along the line 6—6 of FIG. 1.

With particular reference to FIG. 6, the feature of the present invention of adjustability to various sized bags will now be described in detail. Conveyor carriages 40 and 42 are mounted on adjusting shafts 206 and 208. Shafts 206 and 208 have substantially horizontally oriented rotational axes which are parallel to each other and which lie in a common horizontal plane. Shafts 206 and 208 are spaced apart along the elongation axis of apparatus 10. For the purpose of detailed description, the attachment of carriages 40 and 42 to shaft 206 will be described, it being understood that the connection of carriages 40 and 42 to shaft 208 is substantially identical thereto. Shaft 206 includes a first portion 210 and a second portion 212 on which conveyor carriages 40 and 42 are mounted, respectively. Shaft portions 210 and 212 have end projections 214 and 216 which are welded to a tubular connecting member 218 joining portions 210 and 212 together. End projections 214 and 216 are of a outside diameter less than the outside diameter of first second portion 210 and 212. One of first and second portions 210 and 212 is provided with right hand external threads while the other of first and second portions of 210 and 212 is provided with left hand external threads. Sidewalls 44, 46, 48 and 50 of carriages 40 and 42 are provided with aligned apertures through which shaft 206 extends. A pair of internally threaded hexagonal nuts 220 are welded to mounting plates 222 and 224 which are in turn fastened to sidewalls of 50 and 48. A tubular spacing member 226 is disposed about shaft portion 212 between hexagonal nuts 220 and 222. Spacing member 226 is preferably welded to hexagonal nuts 220 and 222. Hexagonal nuts 220 and 222 are provided with right or left hand threads to match the external threads of shaft portions 212. A tubular member 228 is affixed by any convenient means to sidewall 48 and extends inwardly about shaft portion 212. Conveyor carriage 40 has a similar thread engagement with portion 210 of shaft 206. Specifically, a pair of hexagonal nuts 230 are welded to plates 232 and 234 which in turn are mounted to sidewalls 44 and 46, respectively. A tubular spacing member 236 is disposed about shaft portion 210 and welded to hexagonal nuts 230. A tubular member 238 extends from sidewall 36 inwardly about shaft portion 210. Hexagonal nuts 230 are internally threaded with either right or left hand threads to match to the external threads of shaft portion 210. The ends of shaft 206 are rotatably journalled in sidewalls 18 and 20 of housing 12. Shaft portion 212 has an extension 240 which projects exteriorly of sidewall 18. A manual crank or handle 242 is mounted to shaft extension 240. Rotation of 242 will cause carriages 44 and 42 to reciprocate to or away from each other as shown by the double headed arrows at 244 and 246. It will be understood that first and second shaft portions 210 and 212 will be provided with appropriate right and left hand thread such that rotation of handle 242 one direction will cause carriages 40 and 42 to move inward with respect to a central elongation axis of apparatus 10 while rotation in the opposite direction will cause carriages 40 and 42 to move outward with respect to central elongation axis. Pins 98 will therefore be adjustably positioned to accommodate a wide variety of bag sizes such that pins 98 puncture the bag as close to the lateral edge of the bag as possible to ensure complete dumping of the bag contents. The rotation of handle 242 is transmitted to shaft 208 by means of a belt or chain drive designated generally as 248. Belt or chain drive 248 includes a drive wheel or sprocket 250 which is mounted on shaft extension 240 and a driven wheel or sprocket 252. Driven sprocket 252 is mounted on shaft extension 254 of shaft 208. A drive belt chain 256 is wrapped about wheels 250 and 252. Chain idler devices 258 and 260 may be provided to regulate the tension of chain 256. The manual rotation of handle 242 is transmitted to shaft 208. Horizontal reciprocation of carriages 40 and 42 is achieved simultaneously on shafts 206 and 208.

Figure 7:
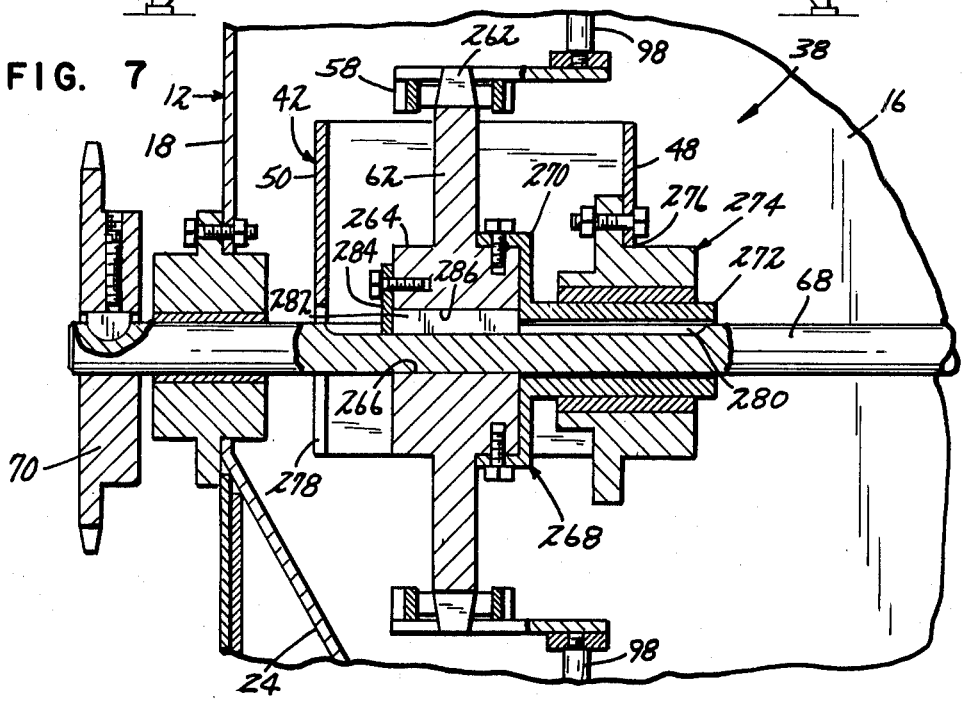
FIG. 7 is an enlarged fragmentary view in section taken generally along line 7—7 of FIG. 4.
Figure 8:
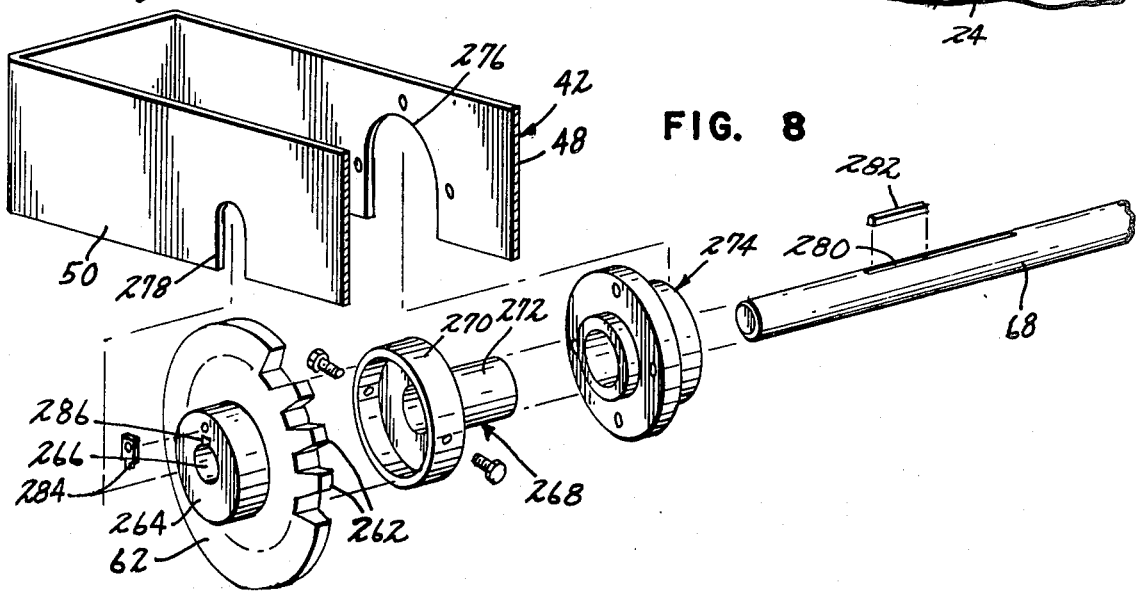
FIG. 8 is an enlarged exploded perspective view showing the connection of the conveyor drive sprocket to the drive shaft.

FIGS. 7 and 8 illustrate the mounting of drive sprockets 60 and 62 on a drive shaft 68. The discussion which follows relates to the connection of drive spocket 62, however, it is understood that similar connection is made between drive sprocket 60 and shaft 68. Sprocket 62 includes a plurality of teeth 262 and a central hub member 264. Hub member 264 has a central axial passageway 266 through which shaft 68 extends. Affixed to the inside of hub 264 is a coupling 268 to include an enlarged collar member 270 and a tubular extension 272 with a central axial passageway therein through which shaft 68 extends. Tubular extension 272 is itself rotatably received within a collar member 274 which is affixed to sidewall 48 of carriage 42 by any convenient means such as nut and bolt fasteners disclosed herein. Sidewalls 48 and 50 are provided with cutouts at 276 and 278 in which collar member 274 and shaft 68 are received respectively. Shaft 68 has an elongated keyway at 280. A key member 282 is received within 280 and retained transversely with hub 264 by coupling 268 and a plate 284 which may be affixed to hub 264 on the opposite side of coupling 268. A slot or recess 286 is provided within central axial passage way 266 of hub member 264 to receive key 282 therein. Key 282 within slot 286 and keyway 280 provide the rotational driving connection between shaft 68 and sprocket 62 as conveyor carriages 40 and 42 are adjusted transversely in the direction of double headed arrows 244 and 246, drive sprocket 60 is also adjusted transversely with associated key 282 sliding within keyway 280. Thus, the drive connection between shaft 68 and sprockets 62 and 60 is maintained during adjustment to fit various size bags. It is understood that alternative equivalent structure for maintaining driving engagement between shaft 68 and sprockets 60 and 62 during horizontal adjustment of carriages 40 and 42 is also within the spirit and scope of the present invention.

As shown in FIGS. 1 and 5, a discharge conveyor apparatus 282 may be disposed on the bottom of housing 12. In the preferred embodiment, bottom wall 24 defines a collection hopper for the material within the bags. In one embodiment, discharge conveyor 288 may be a screw-type conveyor as disclosed herein. Conveyor 288 would have left and right hand flights on opposite sides of discharge opening 30 so that the material collected in the hopper defined by wall 24 would be forced toward opening 30. Alternative means for conveying material to opening 30 could also be utilized to include air slide conveyors and/or mechanical vibration, for example.

The preferred manner of operation of the bag opening and emptying apparatus 10 of the present invention will now be described. In the preferred method of operation, bags as illustrated at 290 are conveyed to apparatus 10 with the bags lying flat on some conveyor mechanism and aligned such the lateral edges of bag 290 will be pierced by pins 98. In FIGS. 1 and 2, a bag 290 is shown as being introduced to apparatus 10 on a generally horizontally oriented conveyor mechanism. The conveyor mechanism may be on the other hand disposed at an upward angle with respect to the horizontal to provide a slight gravational feed of bag 290 into apparatus 10. However, such feature is not deemed critical to the operation of the present invention. Carriages 40 and 42 are adjusted such that pins 98 on chains 56 and 58 pierce the lateral edges of the bag as close to the edge of the bag as possible. As the bag enters opening 26 guide plates 94 and 96 position the bag such that the lateral edges are in position to be pierced by pins 98. Rollers 102 provide support for the bag as it enters opening 26. A flexible opening cover 292 may be provided to prevent dust within housing 12 from escaping through opening 26. As pins 98 pierce the lateral edges of bag 290 the bag is drawn into housing 12 and plates 104 and 106 provide downward pressure on bag 290 facilitating the puncturing of bag 290 by pins 98. Bag 290 is first carried into rotating cutting disc 120. Cutting disc is disposed in a vertical plane substantially along the central elongation axis of apparatus 10. Cutting disc 120 thus cuts through opposite sides of bag 290 substantially along the center of the bag between the lateral edges thereof. Plate 104 also functions to hold the bag down on pins 98 against the cutting force of disc 120 which has a tendency to lift the bag up. As the bag approaches beating zone 136, chains 56 and 58 begin to ride up on surface 174 of ramps 170 and 172. As shown in FIG. 4 and FIG. 9, in particular, pins 98 are tilted inward with respect to the vertical and moved coser to the inside edge of sidewalls 46 and 48. The lateral edges of the bag are thereby tilted upwardly and inwardly. The rotating beater members 148 strike the cut bag driving the contents downward into the hopper defined by bottom wall 24. Hold down rods 150 and 152 maintain the bag in place on 198 against the force of beater members 148 which also tend to disengage the cut bag halves from pins 98. Following beater zone 136, the bag, which has been cut into two halves, is carried into engagement with driven rollers 178 and roller 188. Rods 202 and 204 lift the bag halves generally upward from pins 98 and direct the bag halves to ejection zone 138. The bag halves are captured between rollers 178 and 188 and roller 190 and driven through outlet opening 28 where the bag halves may be disposed of in any convenient fashion. As previously mentioned, material contents of the bag are collected in the hopper defined by bottom wall 24 and conveyed by discharge conveyor 288 toward contents outlet 20. Dust generated within housing 12 may be removed through conventional filter apparatus (not shown) mounted top dust outlet 32. The tilting of pins 98 in beater zone 136 insured a more complete discharge of the contents of the bag. In other words, material within the bag along the lateral edges thereof is dumped from the bag by the tilting of the pins 98 in combination with the displacement of pins 98 closer to the edge of sidewalls 46 and 48.

As previously mentioned, carriages 40 and 42 can be adjusted to accommodate various sized bags and may be accurately positioned such that pins 98 will be as close to the edge of the bag as possible. Therefore there will be a minimum amount of material between pins 98 and the lateral edge of the bag that perhaps cannot be dumped from the bag. Hold down rods 150 and 152 and plates 104 and 106 can be adjusted to accommodate relatively thin or relatively fat bags.

From the above description, it can be seen that the present invention is an automatic opening and emptying bag apparatus and method that can maintain a surrounding environment substantially contamination free of the contents of the bag. The apparatus of the present invention provides a maximum efficiency of the removal of the contents of the bags in addition to being adjustable to fit various size bags.

We claim:

1. Apparatus for automatically opening and emptying bags comprising:

(a) a substantially enclosed housing having a bag inlet end and a bag outlet end, said housing having a cutting zone proximate said inlet end, a bag ejection zone proximate said outlet end, and a bag emptying zone generally between said cutting and ejection zones;

(b) conveyor means disposed in said housing for carrying bags in a generally horizontal plane between said inlet and said outlet, said conveyor means comprising (i) first and second conveyor tracks spaced apart horizontally within said housing and extending generally between said inlet and outlet ends thereof, (ii) first and second endless conveyor members disposed on said first and second tracks and mounted for travel thereon in a generally horizontal plane, (iii) means on said first and second conveyor members for positively engaging the opposite lateral edges of the bags.

(iv) means on said tracks in said emptying zone for tilting said first and second conveyor members from said generally horizontal plane inward toward each other and at an angle with respect to said generally horizontal plane, and (v) means for driving said endless conveyor members;

(c) means disposed within said cutting zone for cutting through opposite sides of the bags between said opposite lateral edges thereof; and (d) means in said ejection zone for removing the cut bag from said conveyor members and ejecting the bag from said housing, wherein said first and second conveyor carriages have substantially planar top surfaces on which said endless conveyor members travel in a generally horizontal plane and wherein said means for tilting said first and second conveyor members comprise first and second ramp portions mounted on said planar surfaces and having surfaces slanted inwardly with respect to a central elongation axis of said apparatus.

2. Apparatus in accordance with claim 1 wherein said means for postively engaging the opposite lateral edges of the bags comprised a plurality of spaced elongated piercing members affixed to said first and second conveyor members and disposed to puncture the bags along the opposite lateral edges thereof.

3. Apparatus in accordance with claim 2 comprising means within said bag emptying zone for beating the bag to remove the contents therefrom.

4. Apparatus in accordance with claim 3 wherein said beating means comprises a shaft mounted for rotation about a substantially horizontal axis within said bag emptying zone, said shaft having at least one beater member affixed thereto and extending radially outward therefrom, said beater member sized to strike said bag; and means for rotatably driving said shaft about said rotational axis.

5. Apparatus in accordance with claim 4 further comprising means for holding said bags on said piercing members in said bag emptying zone.

6. Apparatus in accordance with claim 5 wherein said holding means further comprises first and second hold down bars mounted to said first and second conveyor carriages and extending along said bag emptying zone in position to engage the top surface of the bag in said zone.

* * * * *